US007963886B1

(12) United States Patent
Schwinn et al.

(10) Patent No.: US 7,963,886 B1
(45) Date of Patent: Jun. 21, 2011

(54) METHOD AND APPARATUS FOR FREE WEIGHT ASSISTANCE AND TRAINING SYSTEM

(75) Inventors: Mathew Winston Schwinn, Castle Rock, WA (US); Paul Winston Schwinn, Castle Rock, WA (US); David Crnich, Castle Rock, WA (US); Jonathan Mark Skreen, Kelso, WA (US); Ryan Lesley Crisman, Raleigh, NC (US)

(73) Assignee: Eccentrixx LLC, Castle Rock, WA (US)

( * ) Notice: Subject to any disclaimer, the term of this patent is extended or adjusted under 35 U.S.C. 154(b) by 50 days.

(21) Appl. No.: 12/473,333

(22) Filed: May 28, 2009

Related U.S. Application Data

(60) Provisional application No. 61/130,231, filed on May 30, 2008.

(51) Int. Cl.
*A63B 71/00* (2006.01)

(52) U.S. Cl. ..... 482/5; 482/8; 482/9; 482/98; 482/99

(58) Field of Classification Search ..... 482/1–9, 482/92–99, 900–902; 434/247
See application file for complete search history.

(56) References Cited

U.S. PATENT DOCUMENTS

| | | | | |
|---|---|---|---|---|
| 4,540,171 | A | 9/1985 | Clark et al. | |
| 4,807,875 | A | 2/1989 | Tanski | |
| 5,048,826 | A * | 9/1991 | Ryan | 482/7 |
| 5,314,394 | A | 5/1994 | Ronan | |
| 5,350,344 | A * | 9/1994 | Kissel | 482/98 |
| 5,407,403 | A | 4/1995 | Coleman | |
| 6,494,811 | B1 * | 12/2002 | Alessandri | 482/8 |
| 6,558,299 | B1 | 5/2003 | Slattery | |
| 6,926,648 | B2 | 8/2005 | Capizzo | |
| 6,926,649 | B2 * | 8/2005 | Slawinski | 482/104 |
| 7,163,488 | B2 | 1/2007 | Anders et al. | |
| 7,455,621 | B1 * | 11/2008 | Anthony | 482/8 |
| 7,485,076 | B2 * | 2/2009 | Lee | 482/99 |
| 7,591,771 | B2 * | 9/2009 | Rullestad et al. | 482/104 |

* cited by examiner

*Primary Examiner* — Glenn Richman

(57) ABSTRACT

A free weight assistance and training system and method including a weight support structure. Free weight support arms are movably mounted to the support structure and configured to support a free weight bar. A drive mechanism is operatively coupled to the free weight support arms and configured to move the free weight support arms along the weight support structure. At least one non-contact detector is configured to detect the position of a free weight bar with respect to the free weight support arms without contacting the free weight bar. A controller is configured to receive free weight bar position data from the at least one non-contact detector, process the data and initiate the drive mechanism to move the free weight support arms along the support structure in response to the data.

10 Claims, 4 Drawing Sheets

METHOD AND APPARATUS FOR FREE WEIGHT ASSISTANCE AND TRAINING SYSTEM

REFERENCE

This patent application claims the benefit of U.S. provisional patent application 61/130,231; entitled SELF-SPOTTING WEIGHT LIFTING SYSTEM; filed on May 30, 2008; and hereby incorporated by reference into this patent application.

TECHNICAL BACKGROUND

Weight training is an effective method for increasing skeletal muscle strength, eliminating fat, and improving overall fitness. Resistance exercise (isotonic loading) and, in particular, free weightlifting, are the workout methods of choice for many casual, professional, and elite athletes. During isotonic loading, tension remains unchanged while the muscle's length changes. Each repetition of an isotonic loading or free weightlifting exercise consists of two distinct phases: "concentric" and "eccentric", with each having a markedly different potential for training benefits.

Concentric contractions are typical of most exercise. The muscle tension increases to meet the resistance, then remains the same as the muscle shortens. During a concentric contraction, the external force on the muscle is less than the force the muscle is generating (e.g., a shortening contraction, as in a classic biceps curl). On the other hand, eccentric contractions permit much higher levels of tension on the muscles and, therefore, generate greater muscle strengthening. Eccentric contractions are similar to isometric exercise, with absolute tensions being much greater than the muscle's titanic generating capacity (i.e., you can lower a much heavier weight than you can raise).

Free weightlifting permits unrestrained motion during lifting, closely approximating applications of human strength in many recreational, athletic, and sporting activities. Also, the weight utilized in free weightlifting is more readily repeatable compared to machines employing various levers, cams, springs, pulleys, and resistance elements, such as springs, rubber bands, hydraulics, or pneumatic cylinders. Furthermore, free weights provide uniform resistance unaffected by wear of mechanical parts or other components over time. However, individual gains using both phases are often limited due to safety concerns.

One disadvantage limiting use of free weights is the need for one or more "spotters" to assist the weightlifter, especially in strength-building regimens that are calculated to test the strength and endurance limits of the user. These regimens are most beneficial when the user continues repetitions until he or she is unable to lift the free weight bar, or reaches his or her failure point. Safety thus becomes a significant concern if spotters are not instantly available to assist the user, since the user is likely unable to lift the weight safely to a support device or structure, especially once he or she has reached his or her failure point during such a free weight regimen. Often, even when spotters are immediately available, they may not recognize an unsafe condition, their response may not be sufficiently quick or adequate to prevent injury to the user, or they may not be able to lift the weight, especially when dealing with the amount of weight many elite athletes, professional football players, and Olympic weight lifters are capable of lifting.

Another disadvantage of free weights is that the amount of weight to be lifted is unchangeable during any particular lift, as once the weights are placed on the weight bar, weight cannot be added or subtracted during the lift. Typically, individuals have varying abilities at different points in a particular lifting pattern. For example, generally a lifter is stronger during an eccentric lift. Most athletes are able to perform an eccentric lift with weights up to 150% of their maximum concentric weight. Numerous training benefits may be realized by performing eccentric lifting routines.

Yet, a tremendous risk exists that the weightlifter will not be able to lift the weight off of themselves once he or she has lowered the weight if, for example, the weightlifter is doing an eccentric bench press or eccentric squat exercise. It is not uncommon for an elite athlete to perform an eccentric squat lift with weight exceeding 1,000 lbs, making it nearly impossible for spotters to raise the weight back to the starting position. Thus, if failure occurs during the lift with no spotter present, the lifter is at great risk of serious injury.

Even in the presence of a spotter, safety concerns arise if the spotter is not paying attention or cannot physically lift the weight off of the lifter. This latter concern is especially true during eccentric lifting, where the lifter lowers a greater weight than the lifter can physically lift.

Likewise, when a lifter is performing a concentric lift without a spotter, if the weightlifter cannot lift the bar at any point during the repetitions, or if the lifter harbors any doubt as to his or her ability to complete one more repetition, he or she is forced to stop and is unable to receive the full benefit of the workout. Thus, maximum benefit from the weightlifting routine is never reached.

BRIEF DESCRIPTION OF THE DRAWINGS

Many aspects of the present disclosure may be better understood with reference to the following drawings. The components in the drawings are not necessarily depicted to scale, as emphasis is instead placed upon clear illustration of the principles of the disclosure. Moreover, in the drawings, like reference numerals designate corresponding parts throughout the several views. Also, while several embodiments are described in connection with these drawings, the disclosure is not limited to the embodiments disclosed herein. On the contrary, the intent is to cover all alternatives, modifications, and equivalents.

DETAILED DESCRIPTION

In order that the technical solution of the invention may be fully understood, one or more exemplary and preferred embodiments thereof will now be described with reference to the accompanying drawings. For the purpose of teaching inventive principles, some conventional aspects of the best mode may be simplified or omitted. The following claims specify the scope of the invention. Note that some aspects of the best mode may not fall within the scope of the invention as specified by the claims. Thus, those skilled in the art will appreciate variations from the best mode that fall within the scope of the invention. Those skilled in the art will appreciate that the features described below can be combined in various ways to form multiple variations of the invention. As a result, the invention is not limited to the specific examples described below, but only by the claims and their equivalents.

Figure 1:
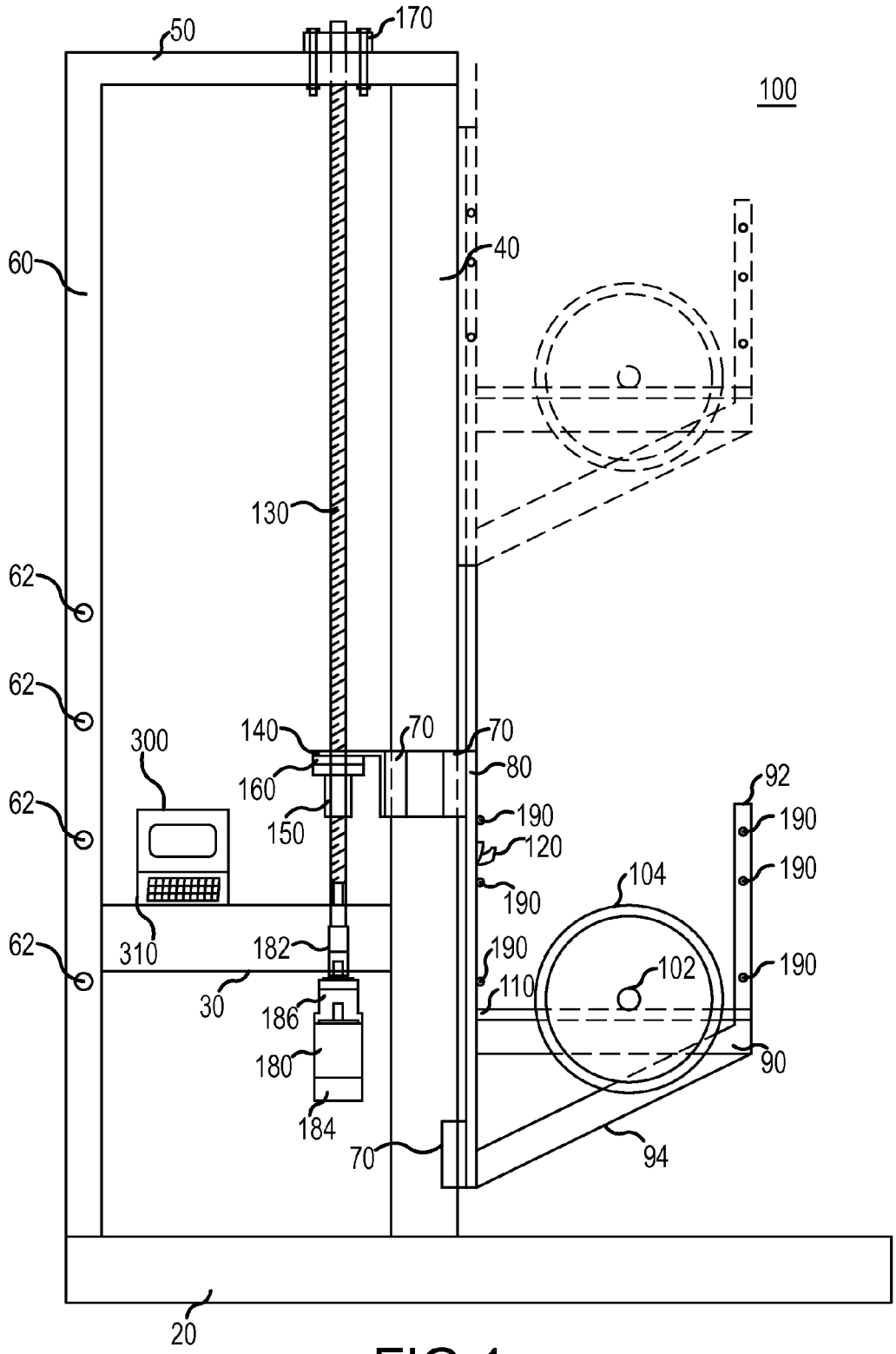
FIG. 1 illustrates a side view of a free weight assistance and training system.

FIG. 1 illustrates a side view of a free weight assistance and training system 100, including a weight support structure (20, 30, 40, 50, 60), free weight support arms 90 movably mounted to the support structure (20, 30, 40, 50, 60) and configured to support a free weight bar 102, a drive mechanism 180 operatively coupled to the free weight support arms 90 and configured to move the free weight support arms 90 along the weight support structure (20, 30, 40, 50, 60), at least one non-contact detector 190 configured to detect the position of a free weight bar 102 with respect to the free weight support arms 90 without contacting the free weight bar 102, and a controller (shown in FIG. 2) configured to receive free weight bar position data from the at least one non-contact detector 190, process the data and initiate the drive mechanism 180 to move the free weight support arms 90 along the support structure (20, 30, 40, 50, 60) in response to the data.

While many configurations of a weightlifting support structure are envisioned, in one embodiment the support structure may comprise a base 20, a horizontal structural support beam 30, a vertical slide column 40, a top horizontal beam 50, and a rear vertical column 60. The support structure may include pegs 62 along the rear vertical column 60. The pegs 62 may be used for storing free weights 104 and other add-on equipment for use with the free-weight assistance and training system 100. The pegs 62 may be placed along any surface, as long as none of the pegs 62, the free weights 104, and the add-on equipment, when racked thereon, interferes with any moving parts of the system 100 or the free weight bar 102.

The weightlifting support structure may be formed of any material capable of supporting the significant weight typical of free weight support structures. One example of such a material is 11-160 IPS extruded structural aluminum bars with rail joints (not shown). Aluminum maximizes strength-to-weight ratio, although various other strong materials may be used in place of aluminum. In one embodiment, the base 20, horizontal structural support beam 30, front vertical slide column 40, and top horizontal beam 50 are made of heavy-wall 11-160 IPS extruded aluminum bars and the rear vertical columns 60 are made of light-wall 10-160 extruded aluminum bars.

The base 20 may take various different forms. In one embodiment, base 20 consists of two substantially parallel rail footprints from which the vertical slide columns 40 are erected. Sliding pads 70 may be movably coupled to vertical slide columns 40. Sliding pads 70 permit smooth gliding or sliding up and down along vertical slide columns 40. Sliding pads 70 on vertical slide columns 40 are connected to a plate 80. Free weight support arms 90 are mounted onto plate 80 spaced apart in a manner to support a free weight bar 102 and permit a weightlifter to be positioned between the free weight support arms 90. Free weight support arms 90 (also referred to as spotting arms or weight-holding arms) may include diagonal support beams 94. Plate 80, free weight support arms 90, and diagonal support beams 94 may be manufactured of steel or any similar material capable of supporting a free weight barbell 102 loaded with weights 104.

Free weight support arms 90 may include bar-centering beams 92 and shock-absorbing pads 110. Shock-absorbing pads 110 may absorb some of the force of the bar 102 coming into contact with the free weight support arms 90, especially during a weightlifting routine when the free weight bar 102 is loaded with weights 104. Shock-absorbing pads 110 may be any shock-absorbing material, such as rubber. Bar-centering beams 92 may assist in keeping the free weight bar 102 within a predetermined space defined between plate 80, free weight support arms 90, and bar-centering beams 92 during a free weightlifting routine and when the free weight bar 102 is resting on the free weight support arms 90. Shock-absorbing material may also be mounted on plate 80 and bar-centering beams 92, if desired, to dampen or absorb the shock of the free weight bar 102 potentially coming into contact with these surfaces in a forced manner. Free weight bar-racking hooks 120 may also be mounted on plate 80, configured to permit racking of the weight bar 102 between routines.

The vertical movement of the free weight support arms 90 is accomplished by the connection of sliding pads 70 to two ball screw shafts 130 by means of brackets 140 and attached bearing nut and flanges 150. The two ball screw shafts 130 are spaced apart and connected to the sliding pads 70 in such a manner as to adequately support a loaded barbell on the free-weight support arms 90. The ball screw shafts 130 may be 1½ inch diameter/1⅞ inch lead ball screw shafts. The brackets 140 may be any strong material, such as steel. The rotational motion of the ball screw shafts 130 within the bearing nut and flanges 150 creates the vertical movement of free weight support arms 90 along the ball screw shafts 130. Bearing nut and flanges 150 may include dampening pads 160 made of any known dampening material, such as rubber. The ball screw shafts 130 are anchored to the top horizontal beam 50 by double bearing supports 170. The ball screw shafts 120, bearing nut and flanges 150, and double bearing supports 170 may be made of any strong material, such as steel, case hardened steel, or the like.

The rotational movement of the ball screw shafts 130 within the bearing nut and flanges 150 may be supplied using two servo type motors 180 in a master/slave configuration. The servo motors 180 may be connected to the ball screw shafts 130 via couplings 182. The servo motors 180 may be equipped with a rotary encoder 184 and a reduction gear box 186 to provide the vertical speed necessary for each exercise. The free weight support arms 90 are held in position along the front vertical slide columns 40 via servo motor 180 that is equipped with rotary encoder 184, which is used to follow the vertical position of the free weight support arms 90 at all times during a lifting routine. A fail-safe disc caliper braking system may be incorporated with the ball screws 130 for further safety.

Free weight bar position detectors 190 may be mounted along bar-centering beams 92 and plate 80 at varying positions above the free weight support arms 90, configured to permit the location, direction of movement, speed, velocity, power, and acceleration/deceleration of the free weight bar 102 to be detected throughout a weightlifting routine. Alternatively, free weight bar position detectors 190 may be positioned along bar centering beams 92 and front vertical slide columns 40. Free weight bar position detectors 190 may be any non-contact position detectors, such as digital photoelectric sensors, infrared sensors, or the like. Non-contact position detectors 190 permit the position, direction of movement, speed, velocity, acceleration, deceleration, and power (position data) of the free weight bar 102 to be determined without interfering with the weightlifting routine. The power may be determined if the user inputs the weight he or she will be lifting with the user interface, the controller may calculate the user's peak, average and mean power during the exercise using weight, velocity, and acceleration data. This information may be displayed to the user immediately and stored so the user may track their progress over time. The free weight bar position detectors 190 transmit the position data of the free weight bar 102 to controller 300.

Controller 300 may be coupled to the non-contact sensors 190 and the servo motor 180 via electrical cables, USB cables, Bluetooth, or other known wired or wireless electronic communication protocol. Controller 300 may be a programmable logic controller (PLC), personal computer, one or more integrated circuits, firmware, any combination thereof, or other known programmable control means. Controller 300 may include a data base or other storage means capable of storing and displaying historical data for recalling or tracking users' progress immediately or over time.

Controller 300 may be programmed for a wide range of lifts, both concentric and eccentric, and may accommodate multiple users independent of physical size or lifting abilities. Each user may have a unique user name or identifier and password for privacy and safety purposes and to prevent others from altering his or her personal settings, personal set-point values, and routines, as is discussed in greater detail below.

Figure 2:
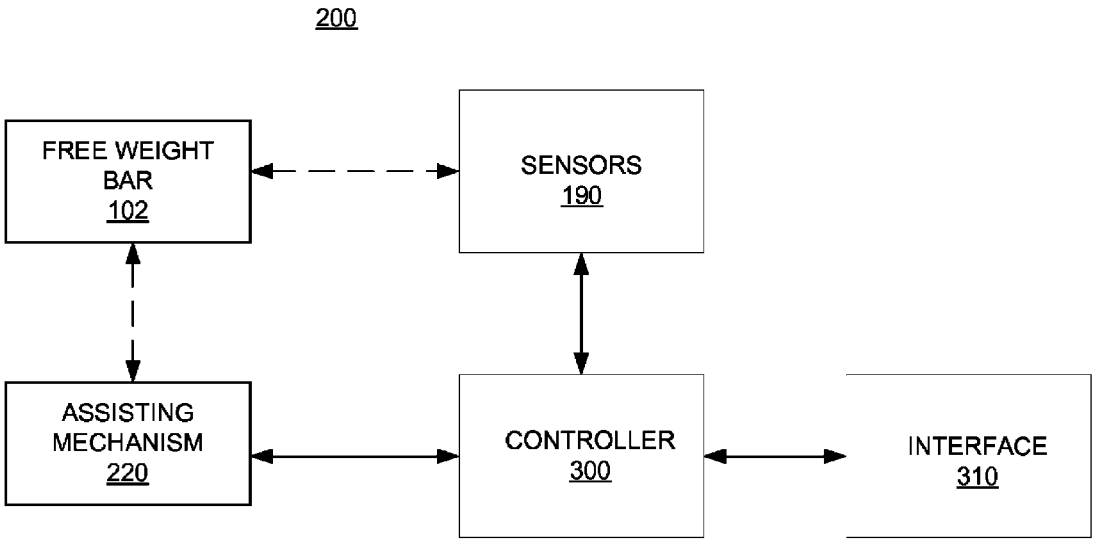
FIG. 2 illustrates a block diagram of a sensing and control circuit for a free weight assistance and training system.

FIG. 2 illustrates a block diagram of a sensing and control circuit 200 for a free weight assistance and training system 100 as shown in FIG. 1. Specifically, FIG. 2 shows a controller 300 operatively connected to receive data from free weight bar position detectors 190. Free weight bar position detectors 190 may be any known non-contact position detectors, such as digital photoelectric sensors, infrared sensors, or similar sensors. Controller 300 may be electrically or wirelessly coupled to free weight bar position detectors 190, such as USB cable, Bluetooth, etc. Free weight bar position detectors 190 are non-contact position detectors, such that they are capable of detecting the position of the free weight bar 102 throughout a lifting routine without making contact with the free weight bar 102.

Controller 300 may also be operatively connected to assisting mechanism 220, such that controller 300 may transmit a signal to assisting mechanism 220 to initiate an assist. Initiating an assist may involve moving the free weight bar support arm 90 to the position of the free weight bar 120. Controller 300 may be electrically or wirelessly coupled to the assist mechanism by any known means, such as USB cable, Bluetooth, or similar means. The assisting mechanism 220 and the free weight support arm 90 are not in contact with the free weight bar 102 during a lift unless the controller 210 sends a signal to the assisting mechanism 220 instructing the assisting mechanism 220 to provide spotting assistance. The assisting mechanism 220 may be the servo motor 180, encoder 184, and reduction gear box 186 with ball screw shafts 130 as described above, or another vertical movement configuration, such as cables or chains with motor, hydraulic, or pneumatic movement means.

Controller 300 may be operatively coupled to a user interface 310 in order to receive input identifying the user, the lifting routine to be performed, the number of repetitions, the number of sets, the weight to be lifted, the start and end positions for support arms 90, etc. The user interface 310 may comprise a keyboard, mouse, graphical touch screen, remote control, voice controller, or other similar known user interface. Controller 300 may also include a push button activator for simplified operation.

Controller 300 may output graphical or other forms of historical data to the user via the user interface 310, such as the last weight lifted for a particular routine, last date of similar lift, number of repetitions (or "reps"), number of sets, a graph of progress for a particular routine over a predetermined period of time, or similar historical information that a weightlifter or their coach may find useful. Controller 300 may have a display or secondary display (not shown) that is located in view of the user for immediate feedback regarding their current lifting pattern. Controller 300 may be password-protected for each user for privacy and safety purposes. When not in use, the controller 300 may lock the entire free weight lifting assistance and training system 100 for safety reasons by means of a password or other similar locking method. Controller 300 may be electrically or wirelessly connected to the user interface 310 by any known means, such as a USB cable, Bluetooth, or similar means. Controller 300 may further include voice-activated emergency mechanisms or emergency switches positioned around the free weight assistance and training system 100 for additional safety.

Figure 3:
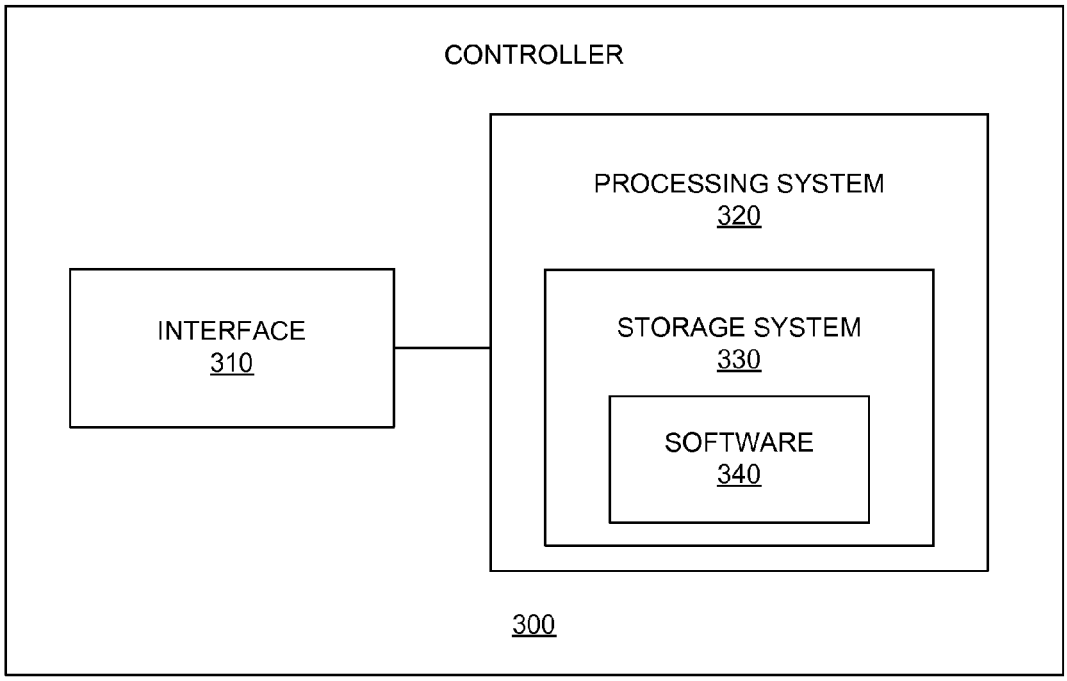
FIG. 3 illustrates a block diagram of a controller of a free weight assistance and training system.

FIG. 3 is a block diagram of a controller 300 of a free weight assistance and training system 100. Controller 300 includes interface 310, processing system 320, storage system 330, and software 340. Processing system 320 is linked to interface 310. Controller 300 may be comprised of a programmed general purpose computer or programmable logic controller, although those skilled in the art will appreciate that programmable or special purpose circuitry and equipment may be used. Controller 300 may use a client-server architecture where operations are distributed among a server system and one or more client devices that together comprise elements 300-340.

Interface 310 may comprise a keyboard, keypad, mouse, touch screen, network interface card, modem, port, or one or more other communication devices. Interface 310 may further be distributed among multiple communication devices. Processing system 320 may comprise a computer microprocessor, logic circuit, or some other processing device. Processing system 320 may be distributed among more than one processing device. Storage system 330 may comprise a disk, tape, integrated circuit, server, or some other memory device. Storage system 330 may be distributed over more than one memory device.

Processing system 320 retrieves and executes software 340 from storage system 330. Software 340 may comprise an operating system, utilities, drivers, networking software, and other software typically loaded onto a general purpose computer. Software 340 may also comprise an application program, firmware, or some other form of machine-readable processing instructions. When executed by the processing system 320, software 340 directs processing system 320 to operate as described herein for the elements of free weight assistance and training system 100.

Figure 4:
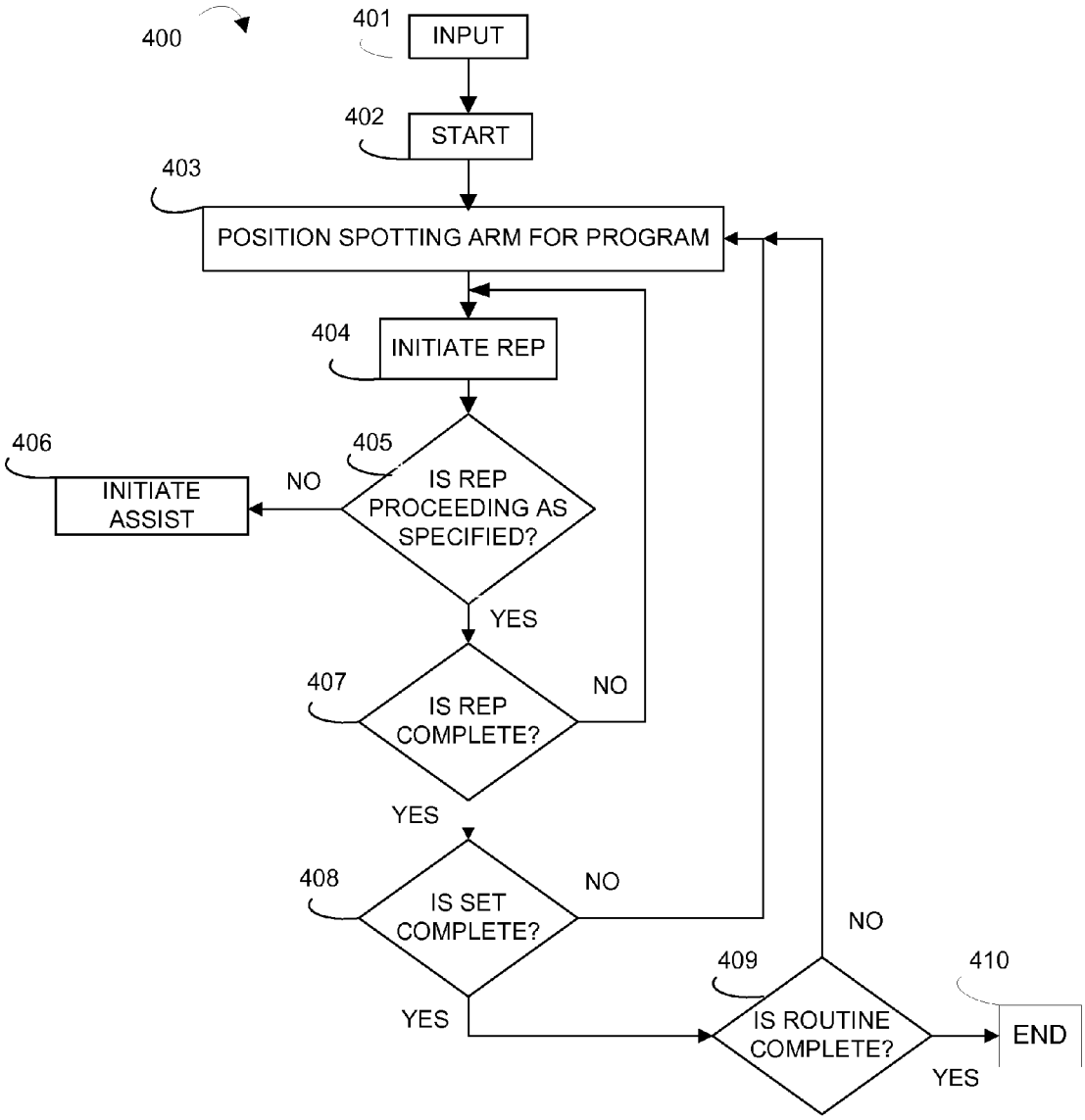
FIG. 4 illustrates a flowchart of a method of operation of a free weight assistance and training system.

FIG. 4 illustrates a flowchart of a method 400 of operating a free weight assistance and training system. Initially, a user inputs 401 their identifier information, password and desired routine, which may cause pre-programmed personal exercise data of the user to be uploaded from the storage system 330 to the processing system 320. At the input stage 401, the user may also enter or modify pre-programmed repetition counter values and enter or modify pre-programmed position set-points that determine the position of the free weight support arms 90 at the beginning, middle, and completion of the exercise routine. The user indicates the start of the exercise routine 402. The free weight support arms 90 are moved via the assisting mechanism 220 to the starting position for the exercise routine 403.

The user initiates the repetition 404 by lifting the free weight barbell 102 off of the free weight support arms 90. The free weight support arms 90 may move to an interim position after the repetition is initiated, so that the free weight support arms 90 will not interfere with the lifting and lowering of the free weight barbell 102 during the exercise. The position detectors 190 will continually determine whether the repetition is proceeding as specified by the user's input 405. If the repetition is not proceeding as specified, such as the free weight barbell 102 has stopped moving in the appropriate direction or has slowed below a predetermined speed for the exercise, then the controller 300 will initiate assistance 406 by moving the free weight support arms 90 to support the free weight barbell 102.

If the repetition is proceeding as specified, the controller 300 determines from highest and lowest position data provided by the position detectors 190 whether the repetition is complete 407. If the repetition is not complete, the free weight support arms 90 remain in the interim position. If the repetition is complete, the controller 300 determines via count data provided by the position detectors 190 whether the set is complete 408. If the set is not complete, the free weight support arms 90 remain in the interim position until the repetition is completed or the support arms 90 will return to the beginning position if the free weight bar bell 102 has not passed through repetition position detector 190 in a predetermined time, such as 3 seconds (ascending) or passes through the initiating position detector 190. If the set is complete, the controller 300 determines via count data provided by the position detectors 190 whether the exercise routine is complete 409. If the exercise is not complete, the controller 300 returns the free weight support arms 90 to the beginning position for the exercise. If the exercise routine is compete, the routine is ended and the controller 300 moves the free weight support arms 90 to a predetermined position for the end of the exercise routine 410. The free weight barbell 102 may be left on the free weight support arms 90 or racked on racking hooks 120 at the end of the exercise routine.

In an isotonic self-spotting (concentric) mode of operation, a user may perform lowering and lifting of the free weight barbell 102 for a specified number of repetitions and sets to complete an exercise routine. The particular exercise routine may be a user-specified or pre-programmed number of reps and sets of an exercise, such as bench press, squats, clean lift, or the like. The user inputs their user identifier and password information along with selecting a personalized, pre-programmed concentric lifting exercise 401. There may be a number of pre-programmed lifting exercises to select from with the user interface 310, such as a graphical touch screen 310. The user would indicate the start of the exercise routine 402. The controller 300 then moves the free weight support arms 90 into a starting position for the exercise routine and user-profile selected 403. The user may position themselves under the weight bar 102 for the exercise routine and initiate the repetition 404 by lifting the free weight barbell 102 off of the free weight support arms 90.

When the position detectors 190 detect the start of the repetition, the controller 300 lowers the free weight support arms 90 to a pre-programmed "low" position for the exercise routine. The "low" position may be low enough not to interfere with the free weight barbell 102 during the repetitions. The user performs their routine of a pre-determined number of sets (e.g., three) of a pre-determined number of repetitions (e.g., 12). Whether a particular repetition is proceeding as specified (405) or complete (407) is determined by the controller 300 with data provided by the position detectors 190. The repetitions are counted by the controller 300 with data provided by the position detectors 190 to determine whether the set is complete 408. When the set is complete and the free weight barbell 102 passes the position detector 190 indicating the final position of the last repetition of the set, the controller 300 may move the free weight support arms 90 to the "up" position and the user may rack the free weight barbell 102 on the racking hooks 120. The controller 300 may be programmed to lift the free weight support arms 90 if the free weight barbell 102 does not maintain a predetermined speed during a repetition (e.g., it does not pass a position detector 190 within a predetermined amount of time or passes through the initiating position detector 190). This scenario may indicate that the user has failed during any of the repetitions.

Alternatively, if the speed of the free weight barbell 102 has slowed below a pre-determined speed or stalled, this event may indicate that the user has hit a weak spot in their lift during which the speed of the barbell 102 is reduced, in which case, the free weight support arms 90 may move to provide a predetermined amount of assistance to permit the user to get past this weak spot, but continue the lifting routine. In another embodiment, the controller 300 may permit a pre-determined number of assists through weak spots before ending the lifting routine and moving the support arms 90 to the "up" position to support the free weight barbell 102.

In another embodiment, the free weight support arms 90 may "shadow" the movements of the free weight barbell during the lifting exercise. Shadowing may entail learning a user's lifting pattern for a particular exercise, such as squats, bench press, clean to press, etc., and then keeping the free weight support arms 90 within a predetermined distance from the user's known lifting pattern. Learning a user's lifting pattern may entail having the user perform a predetermined number of lifts of a particular exercise with a weight the user is confident he can safely lift. The position detectors 190 determine the location, speed, and highest and lowest positions of the exercise. When the user lifts a greater weight than he is certain he can safely lift, the free weight support arms 90 follow a predetermined distance, such as 6-18 inches away from the free weight barbell 102 during the exercise. This shadowing ensures that the free weight support arms 90 are in close proximity of the free weight barbell 102 in the event that spotting (in the event of failure) or assistance (in the event of a weak spot in the user's lifting pattern) is required during the exercise.

In the eccentric self-spotting mode, the user performs only the negative or lowering of the weights for a pre-programmed number of repetitions and sets to complete an exercise routine. The user selects personalized, pre-programmed eccentric lifting routine 401. The user indicates the start of the routine 402. The free weight barbell 102 is positioned on the free weight support arms 90 for this routine and the free weight support arms are raised to the "up" position 403. The user would position themselves under the free weight barbell 102. Upon lifting the free weight barbell 102 off of the free weight support arms 90, the position detectors 190 trigger that the repetition has been initiated 404. The free weight support arms 90 are lowered to the pre-programmed "low" position, which is programmed to ensure that the free weight barbell 102 lands on the free weight support arms 90 at the lowest point of the eccentric lift. When the free weight bar bell 102 passes the lowest position detector 190, indicating that the repetition is complete 407, the controller 300 raises the free weight support arms 90 to the "up" position. The user then continues for the pre-determined number of repetitions in the set. At the end of the set 408, the free weight support arms 90 remain in the "up" position until the user initiates the first repetition of the next set in the routine. This pattern is continued until the eccentric lifting routine is completed 409. At the end of the pre-programmed eccentric lifting routine 410, the free weight support arms 90 are returned to the "up" position until the user initiates the first repetition of the next set in the routine. This pattern is continued until the eccentric lifting routine is completed 409. At the end of the pre-programmed eccentric lifting routine 410, the free weight support arms 90 are returned to the "up" position.

In another embodiment, the free weight support arms 90 may assist in the form of providing a spot if the free weight barbell 102 is being lowered too quickly. In yet another embodiment, the free weight support arms 90 may move ahead of the free weight barbell 102 at a pre-programmed distance and speed to ensure that in the event the user reaches his or her failure point, the free weight barbell 102 is not dropped onto the user and injuring the user. In the event of failure, the free weight support arms 90 would be positioned to "catch" the free weight barbell 102 before it is able to drop onto the user.

In the standard spotting mode, the user performs any lift that may be performed with a human spotter. The free weight barbell 102 is positioned on the racking hooks 120 before the program is selected. The user inputs the selected personalized, pre-programmed "standard lift" 401 from the user interface 310. The controller 300 lowers the self-spotting arms 90 to the "safety" position 403, with the arms 90 acting as a safety rack, such as those found in a squat rack. The user performs the predetermined number of repetitions and sets to complete the selected routine. The user may rack the weights between sets and at the end of the routine. The position detectors 190 may or may not keep track of the location, speed, direction, repetition count, and set count of the routine.

As will be apparent from the above description and drawings, an automated, programmable, free weight assistance and training system is provided comprising a frame onto which moveable free weight support arms 90 are slidably mounted as described. Position detectors 90 are attached to the free weight support arms 90 to provide feedback data on the position, direction, speed, and movement of the free weight barbell 102. The position detectors 90 are electronically or wirelessly coupled to a controller 300 that controls the position of the free weight support arms 90.

A user interface 310 provides the user with an easy and intuitive means to select from any of the fully-automated, personalized, self-spotting concentric and eccentric lifting exercise routines. The controller 300 controls the operation of assisting mechanisms 220 operatively coupled to the free weight support arms 90, permitting the raising and lowering of the free weight support arms 90, in response to the user selected exercise routine and the data provided by the position detectors 190. Lead ball screw shafts 130 permit sliding of the free weight support arms 90 along a pair of smooth, parallel, slide columns 40 running vertically on the frame, which permits concentric and eccentric free weight lifting to be done safely and effectively without a human spotter and without interference with a lift by any touch sensor devices.

Accordingly, the free weight assistance and training system may be employed as exercise equipment for uses ranging from physical therapy to professional level weight training. Specifically, the free weight assistance and training system permits users to perform free weightlifting in the absence of a spotter and without the need of a touch-sensor device for self-spotting and pushing users to the personal failure points without risking injury. Numerous additions may be added to the free weight support arms to perform a wide range of lifts, such as step-ups, pull-ups, etc. The free weight assistance and training system does not alter or interfere with the lifting pattern by means of the lifter having to push a button, switch or pads, nor does the barbell need to touch the spotter arm or any other touch-based sensor(s) to initiate the spotting assistance.

While several embodiments of the invention have been discussed herein, other implementations encompassed by the scope of the invention are possible. For example, while various embodiments have been described primarily using ball screw shafts and servo motors, other means of vertical movement are equally applicable, such as cables or chains with an electric drive system (EDS), motor, hydraulic drive system (HDS), pneumatic drive system, or the like. Although described within the context of a lone exerciser, novice or expert, wanting to maximize their lifting potential, the system is also applicable to collegiate, Olympic, and professional athletes who are capable of lifting (concentric or eccentric) more weight than can safely be spotted by a human spotter.

In addition, aspects of one embodiment disclosed herein may be combined with those of alternative embodiments to create further implementations of the present invention. Thus, while the present invention has been described in the context of specific embodiments, such descriptions are provided for illustration and not limitation. Accordingly, the proper scope of the present invention is delimited only by the following claims and their equivalents.

What is claimed is:

1. A free weight assistance and training system comprising:

a weight support structure;

free weight support arms movably mounted to the support structure and configured to support a free weight bar;

a drive mechanism operatively coupled to the free weight support arms and configured to move the free weight support arms along the weight support structure;

at least one non-contact detector attached to the free weight support arms and configured to detect the position of a free weight bar relative to the free weight support arms without contacting the free weight bar; and a controller configured to receive free weight bar position data from the at least one non-contact detector, process the data and initiate the drive mechanism to move the free weight support arms along the support structure in response to the data, wherein the controller is configured to provide contact between the free weight bar and the free weight support arms by way of the drive mechanism only while providing an assist, between sets, and between routines; wherein the free weight assistance and training system is configured such that there is no contact or support between the free weight support arms and the free weight bar during a lift unless the controller determines assistance is necessary; and wherein the free weight assistance and training system permits the free weight bar freedom of movement unless the controller determines assistance is necessary.

2. The free weight assistance and training system of claim 1, wherein the at least one non-contact detector comprises at least one photoelectric or infrared sensor.

3. The free weight assistance and training system of claim 1, wherein the at least one non-contact sensor and the controller are configured to determine position, direction of movement, speed, velocity, acceleration, deceleration, and power of the free weight bar during a weightlifting routine without interfering with the weightlifting routine unless the controller indicates an assist is necessary.

4. The free weight assistance and training system of claim 1, wherein the controller is further configured for multiple weightlifting programs.

5. The free weight assistance and training system of claim 4, wherein the multiple weightlifting programs comprise programs for different users.

6. The free weight assistance and training system of claim 5, wherein the controller is further configured to analyze a weightlifting pattern of a user and provide assistance at a weak point in the weightlifting pattern.

7. The free weight assistance and training system of claim 4, wherein the multiple weightlifting programs comprise eccentric weightlifting routines.

8. The free weight assistance and training system of claim 4, wherein the multiple weightlifting programs comprise concentric weightlifting routines.

9. The free weight assistance and training system of claim 4, wherein the multiple weightlifting programs comprise shadowing a user throughout a lifting routine and providing assistance at a weak point in the lifting routine.

10. The free weight assistance and training system of claim 1, wherein the controller is configured to cause the free weight support arms to shadow a user's lifting of the free weight bar during a lifting routine and provide assistance at weak spots in the lifting routine.

* * * * *